US005931207A

United States Patent [19]

Gianino

[11] Patent Number: 5,931,207

[45] Date of Patent: Aug. 3, 1999

[54] PORTABLE HOME AND GARDEN SPRAYER, POWER UNIT

[76] Inventor: Rosario N. Gianino, 4723 Pond Apple Dr. South, Naples, Fla. 34119

[21] Appl. No.: 08/811,218

[22] Filed: Mar. 5, 1997

[51] Int. Cl.[6] ..... F04B 17/00; B67D 5/00

[52] U.S. Cl. ..... 141/382; 141/95; 137/223; 137/227; 137/231; 239/373; 417/234; 417/411

[58] Field of Search ..... 141/38, 94, 95, 141/382; 239/153, 154, 302, 308, 373; 137/223, 224, 227, 231; 417/234, 411

[56] References Cited

U.S. PATENT DOCUMENTS

| | | | |
|---|---|---|---|
| 2,465,554 | 3/1949 | Roy | 417/234 |
| 2,629,539 | 2/1953 | Drewes, Jr. | 417/234 |
| 3,173,584 | 3/1965 | Giavasis | 417/411 |
| 4,030,665 | 6/1977 | Koyama | 239/373 |
| 4,034,916 | 7/1977 | Forsberg | 239/373 |
| 4,080,105 | 3/1978 | Connell | 137/224 |
| 4,104,744 | 8/1978 | Odencrantz | 4/159 |
| 4,135,669 | 1/1979 | Bridges et al. | 239/373 |
| 4,301,971 | 11/1981 | Cornelius | 239/373 |
| 4,621,984 | 11/1986 | Fussell | 417/234 |
| 4,651,903 | 3/1987 | Pagliai | 417/234 |
| 4,712,983 | 12/1987 | Moynihan | 417/234 |
| 4,776,766 | 10/1988 | Brent | 417/411 |
| 4,972,975 | 11/1990 | Fuhrig | 222/182 |
| 4,984,742 | 1/1991 | Ellison | 239/373 |
| 5,127,808 | 7/1992 | Nichols et al. | 417/411 |
| 5,395,216 | 3/1995 | Lin | 417/234 |
| 5,399,072 | 3/1995 | Westphal | 417/234 |
| 5,639,226 | 6/1997 | Boutrup et al. | 417/411 |

FOREIGN PATENT DOCUMENTS

WO 95/01225 1/1995 Spain .

*Primary Examiner*—J. Casimer Jacyna
*Attorney, Agent, or Firm*—William F. Hamrock

[57] ABSTRACT

A multi purpose portable hand held compressed air power unit for spraying liquids from a tank or for inflating inflatable items. Said power unit having a trigger operated battery system and external electrical source provided in a housing having an electric motor and an air compressor. An air conduit pipe extends downwardly from the housing supplying compressed air into a liquid tank for spraying or to modified attachments attachable to inflate items such as tires, tubes, water floats or other inflatable items. The alternative electric power source can be used to replace the batteries.

27 Claims, 5 Drawing Sheets

PORTABLE HOME AND GARDEN SPRAYER, POWER UNIT

BACKGROUND OF THE INVENTION

1. Field of the Invention

The invention relates generally to a portable compressed air power unit and method of utilizing the compressed air therefrom and, in particular, to a hand held, trigger operated power unit causing compressed air to be utilized in a plurality of uses such as in spraying liquids from a container and also for inflating tires, tubes and other inflatable items.

2. Description of Prior Art

Portable home and garden sprayers are known to include a cylindrical tank and a manual pumping device threadedly secured to the top of the tank. The manual pumping device requires the user to manually pump air into the tank to build-up sufficient air pressure within the air space above the liquid to be dispensed. Typically, these manual pumping devices require one hundred manual pumping strokes to spray the liquids for just a few seconds. Additional manual pumping is required to pressurize the tank for further spraying. The pumping and spraying procedure is continued until the spraying operation is completed. It is evident that this procedure is physically exhausting for the user, is difficult to use, and is very impractical and antiquated.

A further disadvantage to manual pumping portable home and garden sprayers is the possibility of the user over pressurizing the tank causing the tank to rupture and possibly injuring the user. It is again evident that the manual pumping portable home and garden sprayers are possible safety hazards and the user must be careful when using them.

A large, cumbersome spraying device for the treatment of plants is disclosed in PCT Patent WO 95/01225, dated Jan. 12, 1995. The device includes a tank associated with a compressor actuated by a motor powered by an electric battery through a pressure switch in the tank. When the pressure switch detects a pressure drop within the tank, it starts the motor and compressor, thereby maintaining the product at a constant pressure to obtain uniform spraying. However, this is a large, cumbersome device on wheels which is clearly not applicable to portable, hand held home and garden sprayers for use by the ordinary home gardener. There is a need for a small, compact, portable, hand held, easy to use spraying device for the ordinary user to use about the home and grounds. It would be very advantageous to the user if this hand held, easy to use spraying apparatus was not limited to just a sprayer but also could be used for other purposes such as inflating tires, tubes, footballs, water toys and other inflatable items.

SUMMARY OF THE INVENTION

It is the primary object of the invention to provide a small, compact, portable, hand held compressed air power unit which is releasably attachable to a liquid container for power spraying the liquid completely therefrom.

It is another object of the invention to provide a liquid spraying tank having the necessary safety features to control the air pressure therein.

It is a further object of the invention to provide the above power unit with releasable, attachable elements for use in inflating tires, tubes and other inflatable items.

These and other objects are achieved by the preferred embodiments of the invention. In all preferred embodiments, a small, compact, portable, hand held, self operating, compressed air power unit is enclosed within a two piece plastic housing having threaded extensions for securing the power unit to the portable spraying tank or the inflatable items. The compact compressed air power unit is powered by a rechargeable battery system or an alternate source of external electrical power both of which are connected to a switch module structure. The module structure provides diodes which isolate external power from the battery system and isolate the battery system from the external power respectively, also a normally open push button switch and a capacitor radio frequency interference filter. The switch module structure supplies electrical energy to a micro motor which in turn activates a mini air compressor which supplies pressurized air into the liquid tank for spraying the liquid or to the connecting device for supplying compressed air into the inflatable items.

In the preferred embodiment for a home and garden sprayer, the self operating power unit eliminates the need for manual pumping to pressurize the tank and the hand held power unit satisfies all of the advantages available with the larger cumbersome spraying devices. Further, with respect to the preferred embodiments for attaching to inflatable items, the individual hand held power unit has a plurality of uses not obtainable with other sprayer devices.

In light of the above and other objects that will be obvious from an understanding of the disclosure, the present invention provides an arrangement of elements illustrated in the preferred embodiments which are hereinafter set forth in sufficient detail to enable those skilled in the art to clearly understand the function, operation, construction and advantages of it when read in conjunction with the accompanying drawings.

BRIEF DESCRIPTION OF THE DRAWINGS

The invention will be described in detail with reference to the accompanying drawings wherein.

DETAILED DESCRIPTION OF THE INVENTION

Figure 1:
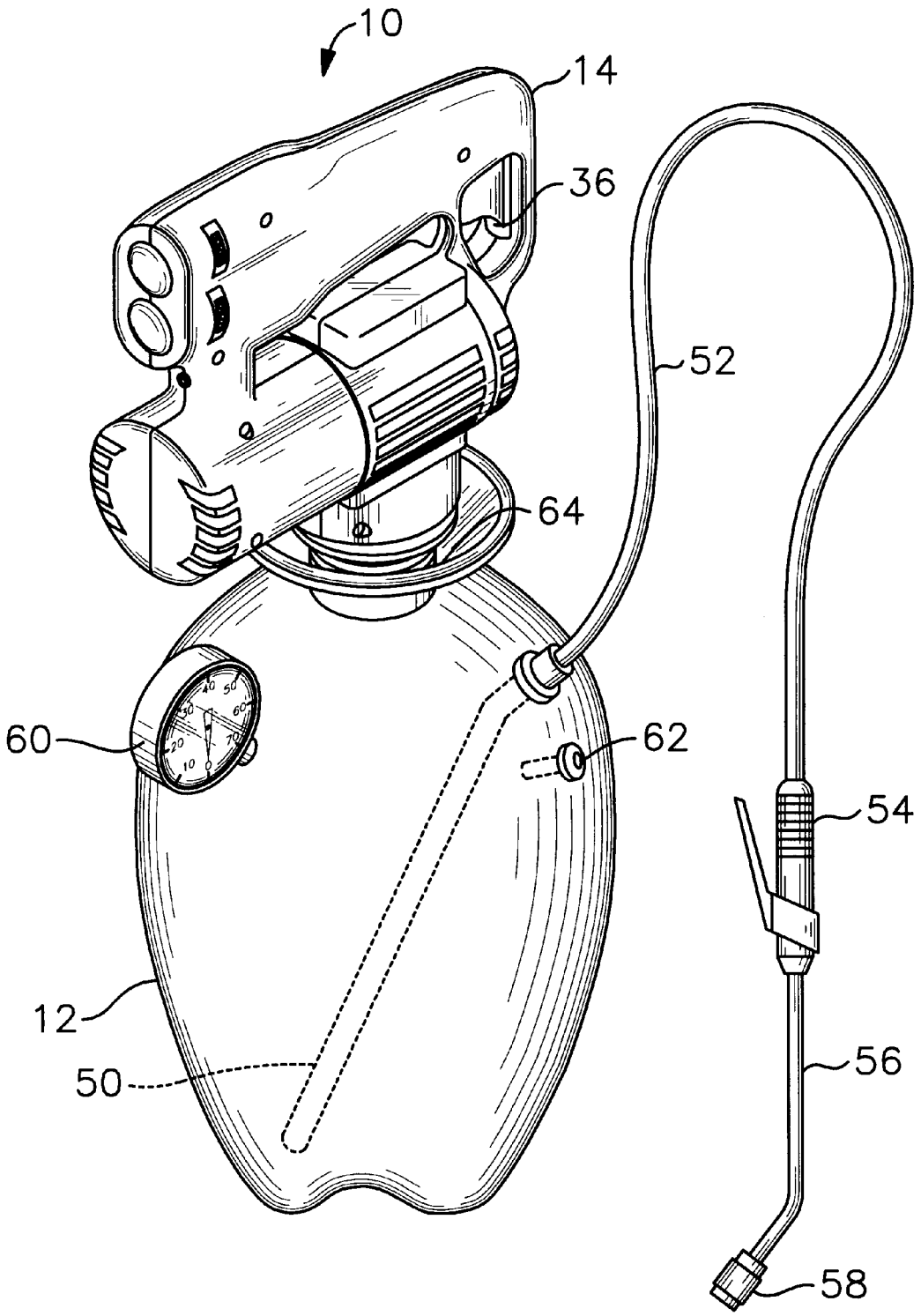
FIG. 1 is a perspective view of the preferred embodiment of the portable home and garden power sprayer including the tank and power unit.

Referring to the drawings, there is shown in FIG. 1 one preferred embodiment of the invention wherein a portable, hand held compressed air power unit 10 is secured to a liquid tank 12 for transmitting liquid under pressure from the tank. The compressed air power unit as seen in FIG. 1 and in the open view in FIG. 2 includes a two piece durable plastic housing 14 enclosing the system. Both sides of the two piece housing are generally symmetrical except that one side incorporates cylindrical embossment 16 shown at its lower end provided with male threads for securing the power unit within the female threaded portion on the top of the tank. The two piece plastic housing is assembled and secured together generally with a number of screws preferably with seven screws providing a space 17 forming a handle so that the power unit can be held with the user's hand.

Figure 3:
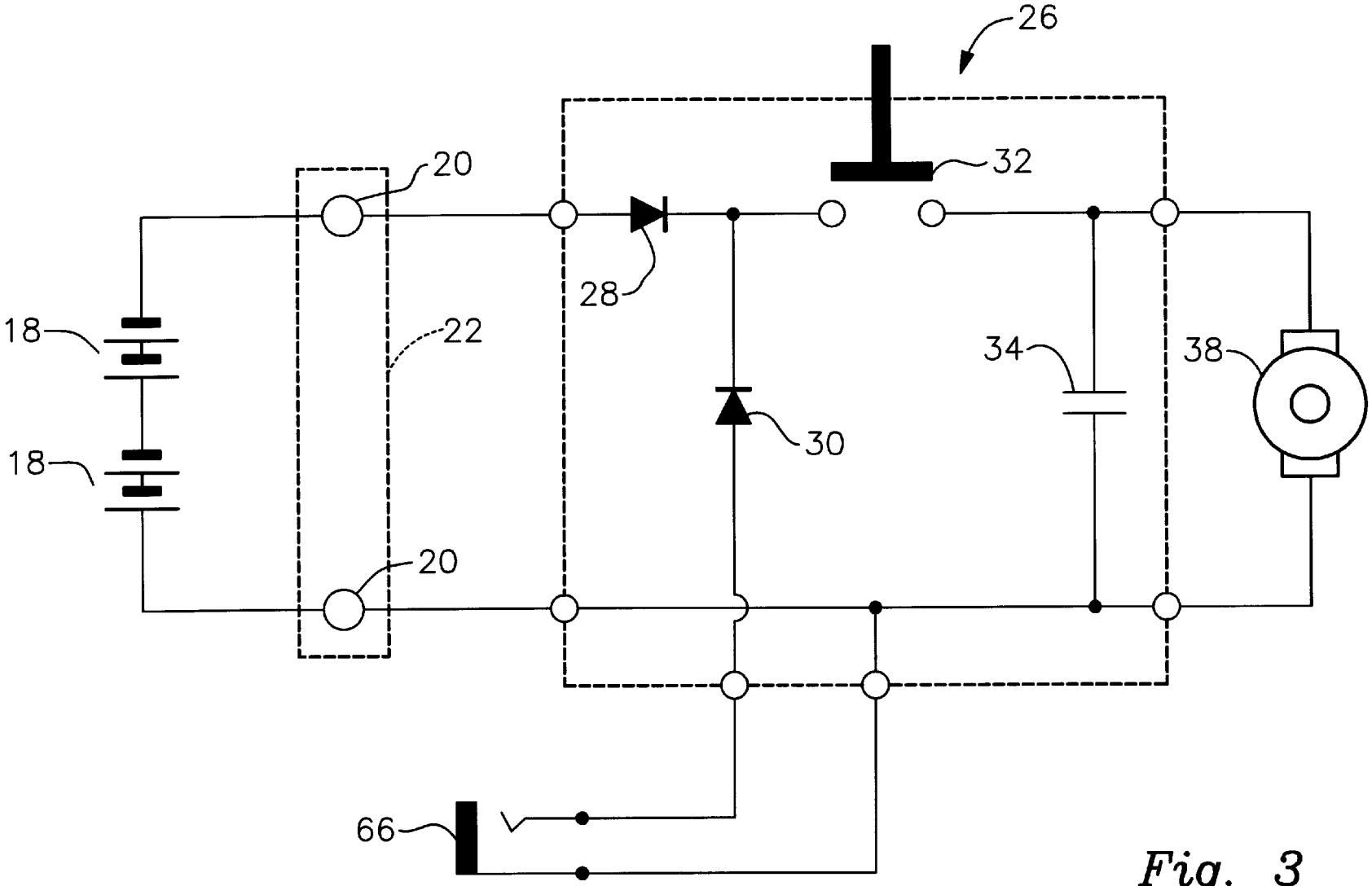
FIG. 3 is a schematic of the switch module circuitry.

The unit is powered by two batteries 18 preferably two 3.6 volt rechargeable nickel-cadmium batteries or by an external source of electrical power by external power attachment 66 which supply the electrical energy required to operate the unit. Thus, two electrical sources are available to energize the system. The batteries are locked in place in the housing with a built-in latching device 20. Both batteries connect into a common terminal block 22 from which wiring 24 connect to a switch module 26. FIG. 3 illustrates a circuit diagram depicting how the switch module communicates in the unit. As indicated in FIG. 3, switch module 26 provides a protector diode DI 28 which isolates the external power from the batteries and provides a protector diode D2 30 which isolates the batteries from the external source of power which is an alternate source of electric power through power attachment 66 to be discussed later. Also illustrated in the switch module are interconnected normally open push button switch 32 and compensation capacitor 34 which is a radio interference filter. The diodes are interconnected within the switch module providing communication between the batteries or external source of power with the push button switch.

Figure 2:
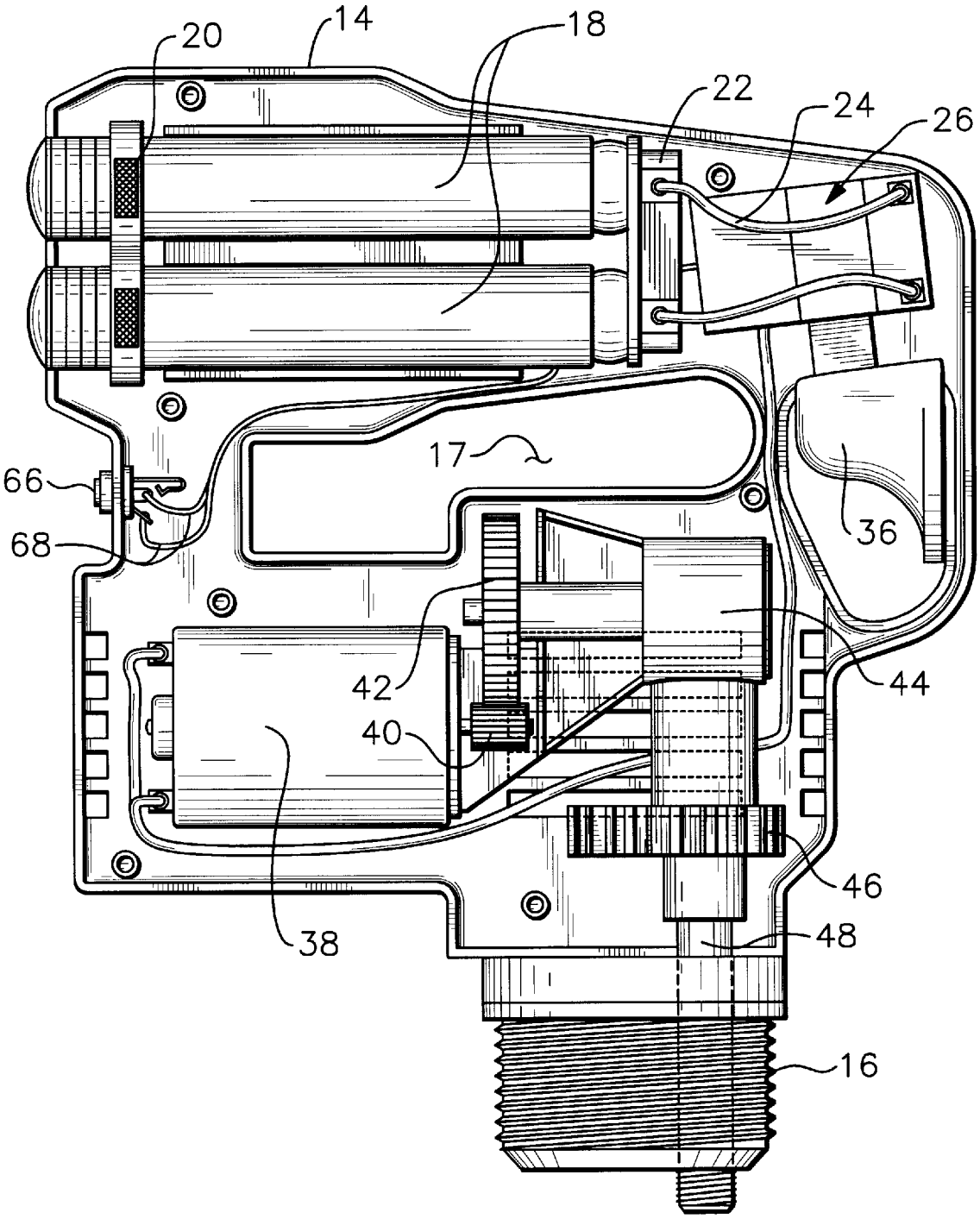
FIG. 2 is an open view of the power unit of FIG. 1.

Switch 32 is connected to manually operated trigger 36 which actuates the switch causing switch module 26 to energize motor 38 through wiring as seen in FIG. 2. Preferably the motor is a micro motor revolving at about 15,000 revolutions per minute. A small drive gear 40 is secured to the motor shaft and movingly engages a larger planetary gear 42 which is operatively connected to an air compressor 44 preferably a mini air compressor. An air conduit pipe 48 is threadedly connected to the air compressor 44 to supply compressed air to the tank. The air conduit pipe is externally threaded at its lower end and extends downwardly from the air compressor within cylindrical embossment 16 located at the lower end of the power unit.

In order to provide for dispersion of the liquid from the tank 12, compressed air is forced from the air compressor through air conduit pipe 48 selectively pressurizing the air space above the liquid level in the tank. This pressure increase will cause the liquid to be forced from the tank up through siphon tube 50 into dispensing hose 52 for spraying by control valve 54 which controls the liquid flow through wand 56 and spray nozzle 58. The pressure in the tank is monitored by means of a conventional air pressure gauge 60 and a conventional preset air pressure relief valve 62 attached to the top of the tank which combine to control the pressure therein and permit safely spraying the contents.

In conducting the spraying operation, the user adds the liquid to the tank and threadedly engages the power unit within the female threaded inlet 64 at the top of the tank. While holding up the power unit and attached tank in his hand, the user activates the trigger 36 to pressurize the tank, and is now able to spray continuously until the tank is empty without any interruptions in the flow of liquid. The spraying is continuous as opposed to the previous manually operated air pumping devices which are subject to constant interruptions.

Figure 5:
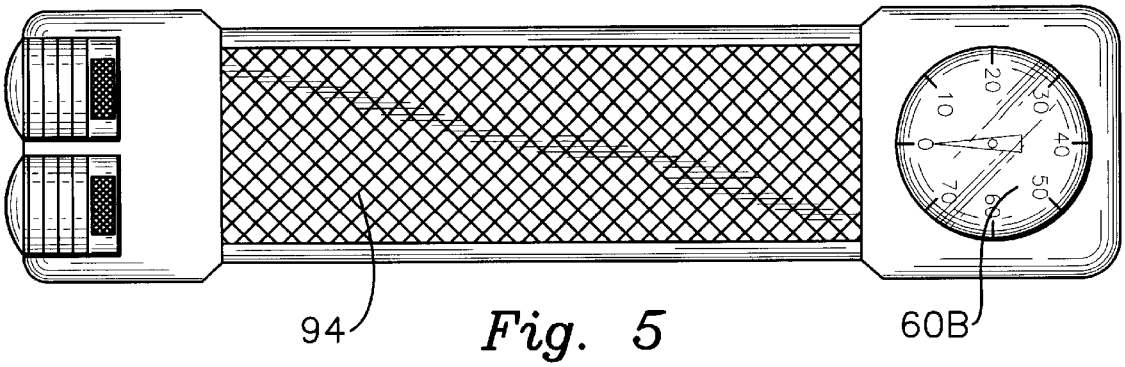
FIG. 5 is a top view of the embodiment of FIG. 4.
Figure 4:
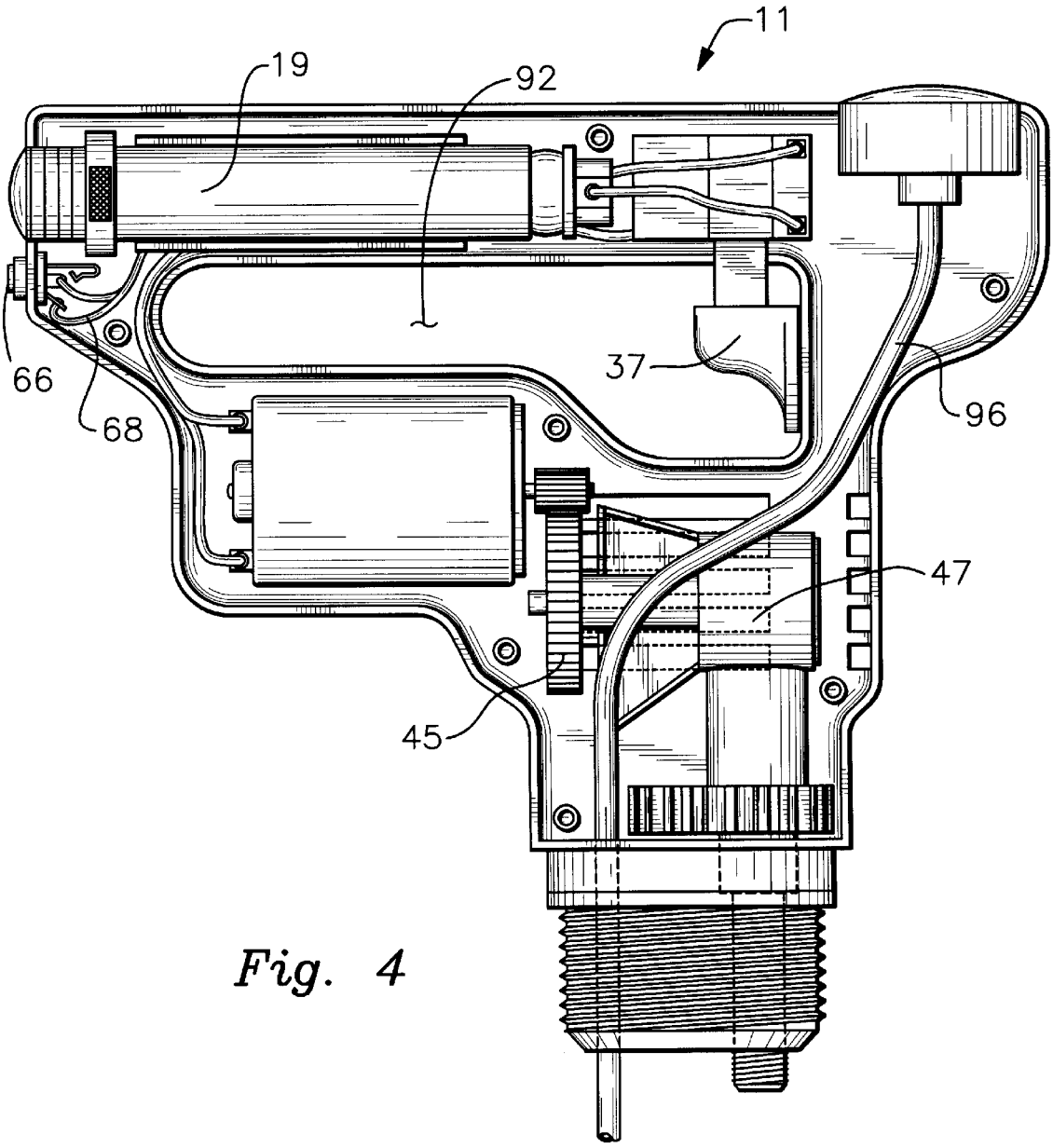
FIG. 4 is an open view of an alternate embodiment of the power unit.
Figure 6:
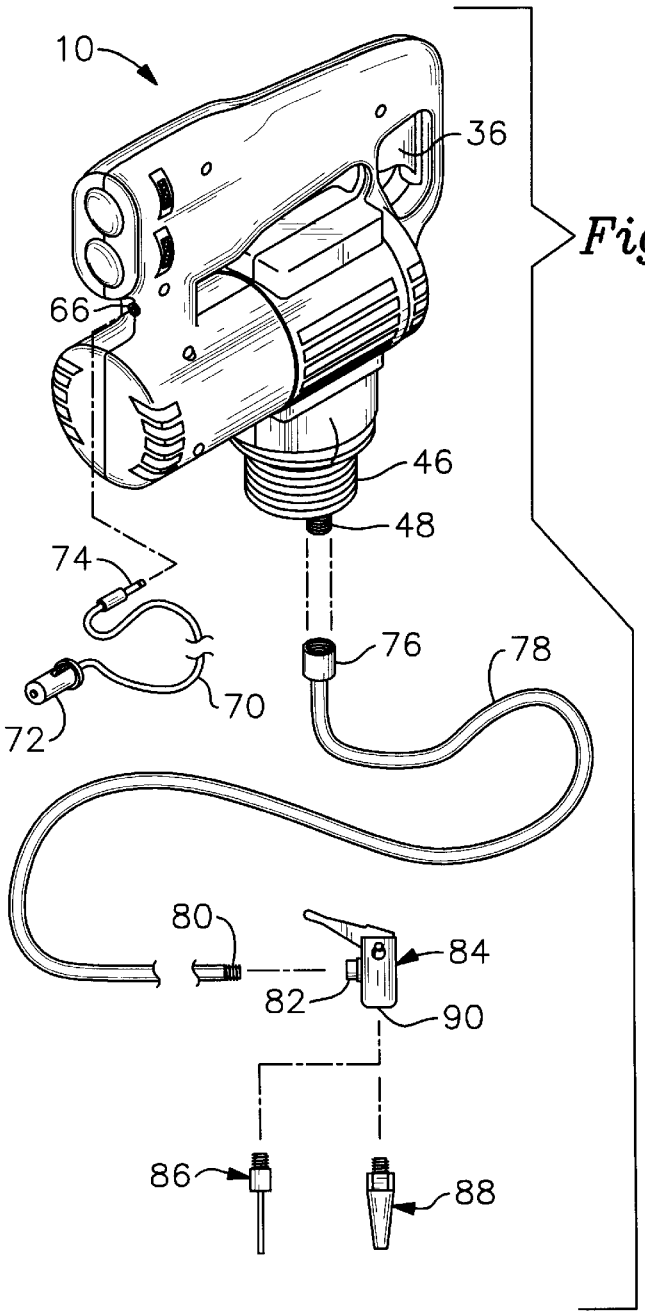
FIG. 6 is a perspective view of other embodiments with attachments for inflatable items and alternate power source.

Further shown in FIGS. 1,2 and 5 is an external power attachment 66 which is the alternate external power source previously mentioned preferably a miniature phone jack for a conventional external power adaptor to be used with a conventional external source of electrical power such as from a cigarette lighter. As seen in FIGS. 2, 4 and 6, external power attachment 66 is connected by wiring 68 to switch module 26 as an alternate source of power in place of the batteries. The external power adaptation cord 70 is shown in FIG. 6 which is an extended electrical cord conductively connected by a conventional electrical adapter 72 at its outer end to a source of electrical power such as an automobile cigarette lighter and its opposite end by a conventional electrical inner adapter 74 to the external power attachment 66 such as a miniature phone jack.

Shown in FIG. 6 is how the hand held power unit 10 is used to inflate tires, tubes, footballs, water toys and other inflatable items. An extended compressed air tube 78 is threadedly connected by threaded female adapter 76 to air conduit pipe 48 extending downwardly from within the cylindrical embossment 16. The outer end 80 of air tube 78 is externally threaded so as to be threadedly connected within air inlet 82 of the conventional valve stem adapter 84. Air pin-ball attachment 86 and inflatable flotation attachment 88 are threadedly connected within the air outlet 90 of the valve stem adapter. When trigger 36 of power unit 10 is activated, the operation of valve stem adapter 84 controls the compressed air supplied to the inflatable items.

Shown in FIGS. 4 and 5 is an alternate preferred embodiment of the power unit of the invention. As seen in FIG. 4, the modified power unit 11 includes the two modified positioned batteries 19 located side by side in the upper portion of the unit having only one open handle space. The power unit trigger 37 is now located in the modified open handle space 92 below the switch module. The modified in position air compressor 47 is then located below the micro motor so that the modified large planetary gear 45 contact with the small drive gear is from below. As seen in FIG. 5, the modified compressed air gauge 60B is located in the modified power unit handle 94 with the air pressure gauge tube 96 extending downwardly through the cylindrical embossment which will extend into the air space in the liquid tank. The modified power unit 11 will make it easier to hand carry the unit and to be able to read the air pressure directly from the handle of the power unit.

Figure 7:
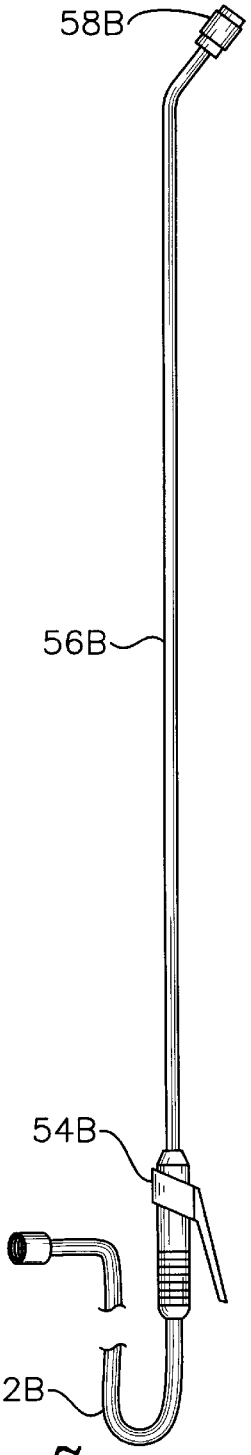
FIG. 7 is a view of a long wand attachment for spraying.

A final embodiment of the invention is shown in FIG. 7 wherein an extended dispensing hose 52B is attached to a modified control valve 54B from which extended wand 56B is attached to the extended spray nozzle 58B. The extended wand embodiment will allow spraying in difficult to reach areas, such as trees.

From the foregoing detailed description of the present invention, it will be seen that the invention effectively overcomes the deficiencies of prior art devices and provides significant advantages over all prior art devices. Changes may be made in the combination and arrangement of parts and elements as heretofore set forth in the specification and shown in the drawings without departing from the sprit and scope of the invention.

What is claimed is:

1. A hand held portable compressed air power unit for pressurizing a liquid tank and inflating items comprising, a housing, an electrical source energizingly connected to a trigger operated switch, said switch interconnected with a motor coupled to a gear in communication with an air compressor, said housing having means to attach the liquid tank and said compressor having an air conduit extending downwardly therefrom with means to attach inflatable items, whereby activating the trigger operated switch energizes the motor the motor motivating the gear and compressor causing compressed air to flow through the air conduit pressurizing both the liquid tank and inflatable items.

2. A power unit according to claim 1 wherein said electrical source comprises a battery system.

3. A power unit according to claim 2 wherein said battery means includes two rechargeable nickel-aluminum batteries.

4. A power unit according to claim 3 wherein said batteries communicate with a terminal block.

5. A power unit according to claim 1 wherein said electrical source comprises an external source of electrical power.

6. A power unit according to claim 1 wherein said external source of electrical power includes a miniature phone jack.

7. A power unit according to claim 6 wherein said phone jack is electrically connectable through an adaptor to a source of electrical energy.

8. A power unit according to claim 7 wherein said adaptor comprises an extended cord connected to an automobile cigarette lighter.

9. A power unit according to claim 1 wherein said electrical source comprises a battery system and an external source of electrical power.

10. A power unit according to claim 9 wherein said trigger operated switch includes a switch module.

11. A power unit according to claim 10 wherein said switch module comprises a first protector diode which isolates an external source of power from the battery system and a second protector diode which isolates the battery means from the external source of power.

12. A power unit according to claim 11 which comprises a normally open push button switch and a compensation capacitor.

13. A power unit according to claim 1 wherein said motor means comprises a micro motor.

14. A power unit according to claim 1 wherein said gear comprises a small drive gear in communication with the motor means and movingly engaging a larger planetary gear.

15. A power unit according to claim 14 wherein said planetary gear is operatively connected to said air compressor.

16. A power unit according to claim 15 wherein said air compressor comprises a mini air compressor.

17. A power unit according to claim 16 wherein said mini air compressor comprises a cylindrical embossment extending downwardly therefrom.

18. A power unit according to claim 17 wherein said cylindrical embossment means for attaching the liquid tank comprises external threads at its lower end.

19. A power unit according to claim 18 wherein said air conduit comprises an air conduit pipe extending downwardly from within said cylindrical embossment.

20. A power unit according to claim 19 wherein said air conduit pipe is externally threaded at its lower end as means to attach inflatable items.

21. A power unit according to claim 20 wherein said conduit pipe is threadedly connectable to one end of a flexible compressed air tube which is threadedly connectable at its opposite end to a valve stem adapter.

22. A power unit according to claim 21 wherein said valve stem adapter is threadedly connectable to inflatable adapters for inflating inflatable items.

23. A power unit according to claim 19 wherein said cylindrical embossment is threadedly connectable to and liquid spray tank.

24. A power unit according to claim 23 wherein said liquid spray tank comprises an air pressure guage and pressure relief valve.

25. A power unit according to claim 24 wherein said liquid spray tank comprises a dispensive spray system having a control valve and spray wand.

26. A power unit according to claim 1 wherein said power unit is enclosed in a plastic casing forming a handle at its upper end.

27. A method of air pressurizing a liquid tank for spraying liquid and inflating inflatable items comprising attaching a hand held compressed air power unit to the liquid tank or inflatable item, energizing a trigger operated switch by means of an electrical source, activating said trigger energizes a motor motivating a gear energizing an air compressor pressurizing both said liquid tank and spraying liquid therefrom and inflating inflatable items.

* * * * *

UNITED STATES PATENT AND TRADEMARK OFFICE

CERTIFICATE OF CORRECTION

PATENT NO. : 5,931,207
DATED : Aug. 3, 1999
INVENTOR(S) : Gianino

It is certified that error appears in the above-identified patent and that said Letters Patent is hereby corrected as shown below:

The title page should be deleted to appear as per attached title page.

Signed and Sealed this

Fourteenth Day of September, 1999

*Attest:*

Q. TODD DICKINSON

*Attesting Officer*

*Acting Commissioner of Patents and Trademarks*

US005931207A

United States Patent [19]

Gianino

[11] Patent Number: 5,931,207

[45] Date of Patent: Aug. 3, 1999

[54] PORTABLE HOME AND GARDEN SPRAYER, POWER UNIT

[76] Inventors: Rosario N. Gianino, 980 Cape Marco Drive Apartment 1008, Marco Island, Florida 34145

[21] Appl. No.: 08/811,218

[22] Filed: Mar. 5, 1997

[51] Int. Cl.[6] ..... F04B 17/00; B67D 5/00

[52] U.S. Cl. ..... 141/382; 141/95; 137/223; 137/227; 137/231; 239/373; 417/234; 417/411

[58] Field of Search ..... 141/38, 94, 95, 141/382; 239/153, 154, 302, 308, 373; 137/223, 224, 227, 231; 417/234, 411

[56] References Cited

U.S. PATENT DOCUMENTS

| | | | |
|---|---|---|---|
| 2,465,554 | 3/1949 | Roy | 417/234 |
| 2,629,539 | 2/1953 | Drewes, Jr. | 417/234 |
| 3,173,584 | 3/1965 | Giavasis | 417/411 |
| 4,030,665 | 6/1977 | Koyama | 239/373 |
| 4,034,916 | 7/1977 | Forsberg | 239/373 |
| 4,080,105 | 3/1978 | Connell | 137/224 |
| 4,104,744 | 8/1978 | Odencrantz | 4/159 |
| 4,135,669 | 1/1979 | Bridges et al. | 239/373 |
| 4,301,971 | 11/1981 | Cornelius | 239/373 |
| 4,621,984 | 11/1986 | Fussell | 417/234 |
| 4,651,903 | 3/1987 | Pagliai | 417/234 |
| 4,712,983 | 12/1987 | Moynihan | 417/234 |
| 4,776,766 | 10/1988 | Brent | 417/411 |
| 4,972,975 | 11/1990 | Fuhrig | 222/182 |
| 4,984,742 | 1/1991 | Ellison | 239/373 |
| 5,127,808 | 7/1992 | Nichols et al. | 417/411 |
| 5,395,216 | 3/1995 | Lin | 417/234 |
| 5,399,072 | 3/1995 | Westphal | 417/234 |
| 5,639,226 | 6/1997 | Boutrup et al. | 417/411 |

FOREIGN PATENT DOCUMENTS

WO 95/01225 1/1995 Spain .

*Primary Examiner*—J. Casimer Jacyna
*Attorney, Agent, or Firm*—William F. Hamrock

[57] ABSTRACT

A multi purpose portable hand held compressed air power unit for spraying liquids from a tank or for inflating inflatable items. Said power unit having a trigger operated battery system and external electrical source provided in a housing having an electric motor and an air compressor. An air conduit pipe extends downwardly from the housing supplying compressed air into a liquid tank for spraying or to modified attachments attachable to inflate items such as tires, tubes, water floats or other inflatable items. The alternative electric power source can be used to replace the batteries.

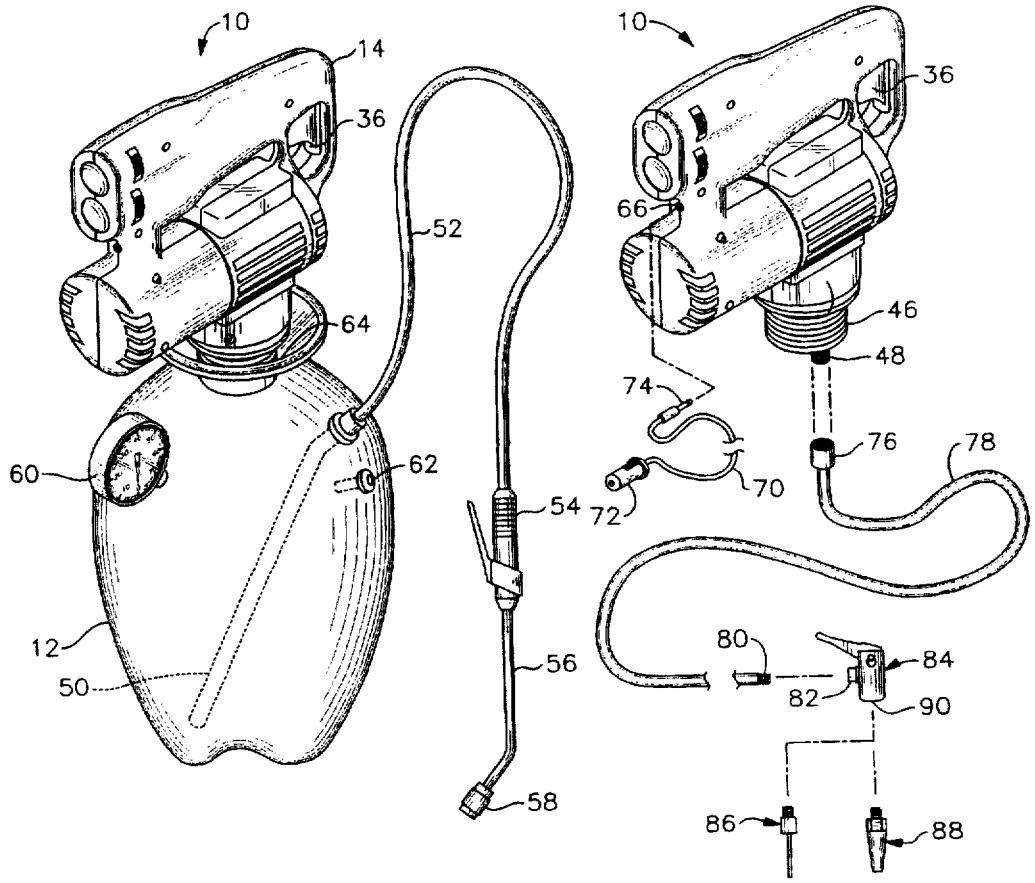

27 Claims, 5 Drawing Sheets